US011033090B2

(12) United States Patent
Hodges et al.

(10) Patent No.: US 11,033,090 B2
(45) Date of Patent: Jun. 15, 2021

(54) APPARATUS AND METHOD FOR HEATING DEPILATORY WAX

(71) Applicant: Michael Andrew Hodges, Milton, FL (US)

(72) Inventors: Michael Andrew Hodges, Milton, FL (US); Donald Warren Cox, Decatur, GA (US); Barbara Lynn Parker, Phenix City, AL (US)

(73) Assignee: Michael Andrew Andrew Hodges, Milton, FL (US)

( * ) Notice: Subject to any disclaimer, the term of this patent is extended or adjusted under 35 U.S.C. 154(b) by 278 days.

(21) Appl. No.: 15/929,020

(22) Filed: Jun. 6, 2018

(65) Prior Publication Data

US 2019/0313763 A1 Oct. 17, 2019

Related U.S. Application Data

(60) Provisional application No. 62/516,020, filed on Jun. 6, 2017.

(51) Int. Cl.
*A45D 26/00* (2006.01)

(52) U.S. Cl.
CPC .... *A45D 26/0014* (2013.01); *A45D 2026/008* (2013.01)

(58) Field of Classification Search
CPC ..... A45D 26/0014; A45D 2026/008
USPC ..... 220/577
See application file for complete search history.

(56) References Cited

U.S. PATENT DOCUMENTS 5,127,554 A * 7/1992 Loychuk ..... B65D 83/0061 222/183
6,736,285 B2 * 5/2004 Stewart-Stand ..... A45F 3/20 206/218
2014/0127367 A1 * 5/2014 Wolf ..... A23G 9/26 426/241

FOREIGN PATENT DOCUMENTS

EP 1568294 * 2/2004
GB 2435687 * 3/2007

* cited by examiner

*Primary Examiner* — Anthony D Stashick
*Assistant Examiner* — Raven Collins
(74) *Attorney, Agent, or Firm* — Kintner IP, LLC; Mary Frances Ludwig; Michael Andrew Hodges

(57) ABSTRACT

An apparatus for heating depilatory wax includes a reservoir and a collar, the reservoir formed of a resilient, heat resistant material. The reservoir is dimensioned to be received by a heating chamber of a wax warmer. The collar has a lip sized to extend outwardly from a top opening of the reservoir, to catch wax which may otherwise drip between the reservoir and warmer. The reservoir may be flattened for shipment or storage, and may be trimmed to accommodate many sizes of wax warmers. In embodiments, the reservoir and collar are nonstick and may be readily cleaned and reused. In embodiments, the reservoir and collar are formed of silicone. A method of distributing a hair removal kit includes packaging soft wax in bags, flattening and packaging reservoirs and collars, and shipping the kit to a user in an environmentally friendly and cost efficient manner.

2 Claims, 4 Drawing Sheets

APPARATUS AND METHOD FOR HEATING DEPILATORY WAX

CROSS REFERENCE TO RELATED APPLICATION

This application claims the filing benefit under 35 U.S.C. § 119(e) of U.S. Provisional Application No. 62/516,020, filed 6 Jun. 2017, which is hereby incorporated by reference.

TECHNICAL FIELD

The present invention pertains generally to beauty treatment, and more particularly to an apparatus and method for heating depilatory wax.

BACKGROUND OF THE INVENTION

In current practice, soft depilatory wax is packaged for sale and use in rigid metal cans which an aesthetician or user places into a wax warmer for heating. Common round-ended applicators cannot reach into the corner formed between the side wall and bottom of the can, and therefore some wax remains in the can and is wasted. After use, the can is generally disposed of along with any wax remaining in the can, resulting in significant material and monetary waste.

Multiple cans may be packaged together for shipment. The shape and rigidity of the cans results in wasted space in the shipping container, and leads to higher than necessary shipping costs. Additional package space is used and money spent on packaging materials to protect the cans from damage in transport.

There is therefore a need in the art for an apparatus for heating depilatory wax which can be easily cleaned and reused, packaged and shipped in a cost-efficient manner, and reduces or eliminates wasted wax, packaging material, and wax containers.

BRIEF SUMMARY OF THE INVENTION

The present invention is directed to an apparatus for heating hard or soft depilatory wax which includes a reservoir comprised of a resilient material, and a collar. An apparatus of the embodiments described herein has never been used in the hair removal industry for the purpose of containing and heating depilatory wax, and provides several beneficial features, including easy cleaning and reuse, and reduced waste of both wax and packaging. A system is provided for packaging and distributing the apparatus with soft wax packaged in bags, offering decreased shipping cost over current methods.

In accordance with an embodiment an apparatus for heating depilatory wax in a cooperating wax warmer includes:

a reservoir shaped and dimensioned to be received by a heating chamber of the wax warmer, the reservoir having a sidewall and a top opening, the top opening having an inner profile internal to and defined by the sidewall, and an outer profile at the periphery of the sidewall;

a collar configured for placement adjacent the top opening of the reservoir, the collar having a lip sized to extend outwardly from the outer profile of the top opening of the reservoir, and an aperture surrounded by the lip and configured for alignment with the top opening; and, wherein the reservoir is formed of a resilient, heat resistant material.

In accordance with another embodiment, the lip of the collar is sized to completely cover the heating chamber of the wax warmer. This features prevents wax from dripping into the heating chamber of the wax warmer, and permits use of a reservoir which is sized slightly smaller than the heating chamber.

In accordance with another embodiment, the collar has a bottom portion configured for insertion through the top opening of the reservoir such that the lip remains external to the reservoir.

In accordance with another embodiment, the reservoir and the collar are formed of a nonstick material. In accordance with another embodiment, the reservoir is formed of a silicone rubber material. In accordance with another embodiment, the collar is formed of a silicone rubber material.

In accordance with another embodiment, the reservoir has a bottom which is convex and forms a curved abutment with the sidewall internal to the reservoir. This feature permits an applicator with a rounded end to access the internal bottom edge of the reservoir for more complete removal of wax.

In accordance with another embodiment, the apparatus includes a lid having a closed top and a bottom lid portion below the closed top, and the bottom lid portion is configured for insertion through the top opening of the reservoir. In accordance with another embodiment, the lid has an outer edge sized to cover the heating chamber of the wax warmer and configured to remain external to the reservoir.

Other embodiments, in addition to the embodiments enumerated above, will become apparent from the following detailed description, taken in conjunction with the accompanying drawings, which illustrate, by way of example, the principles of the apparatus and method of use.

DETAILED DESCRIPTION OF THE INVENTION

Figure 1:
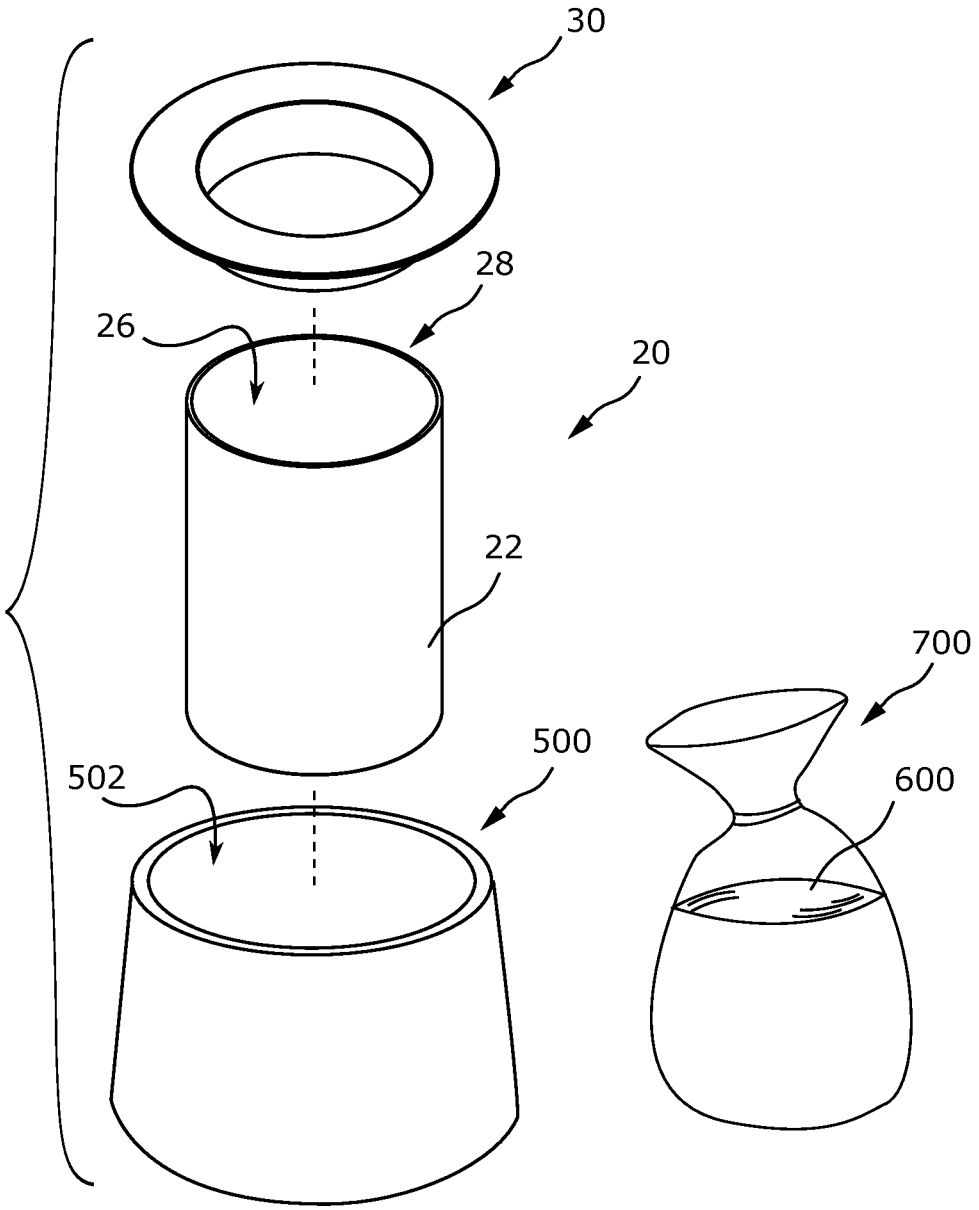
FIG. 1 is a reduced exploded perspective view of an apparatus for heating depilatory wax.
Figure 4:
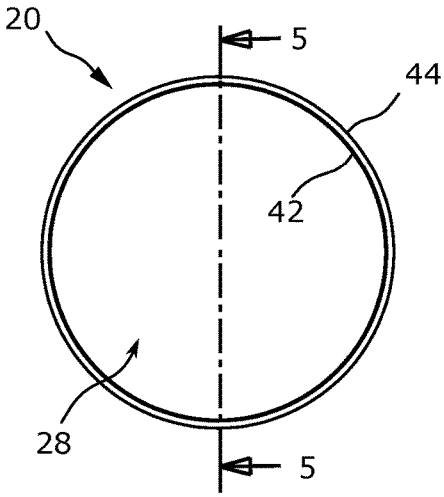
FIG. 4 is a top view of the reservoir.

Referring initially to FIG. 1, there is illustrated a reduced exploded perspective view of an apparatus for heating depilatory wax in a cooperating wax warmer. The apparatus includes a reservoir 20 and a collar 30. The wax warmer is generally designated 500. Reservoir 20 is shaped and dimensioned to be received by a heating chamber 502 of wax warmer 500. Reservoir 20 has an interior 26 which is configured to receive a portion of a depilatory wax 600 and to contain the wax while being heated for use. A collar 30 is configured for placement adjacent a top opening 28 of the reservoir. Collar 30 has a lip 34 which is sized to extend outwardly from an outer profile 44 of the reservoir top opening 28 (see FIGS. 4 & 10). Lip 34 is designed to cover any gap between reservoir 20 and wax warmer 500, for purposes of catching spilled or dripped wax and preventing such wax from directly entering heating chamber 502.

FIGS. 2-5 are, respectively, perspective, front, top, and cross-sectional views of reservoir 20. Reservoir 20 is substantially rotationally symmetric about a longitudinal axis extending from top opening 28 to a bottom 24; therefore, views of the rear and left and right sides are substantially identical to the view of FIG. 3. Reservoir 20 has a sidewall 22 by which interior 26 is defined. Sidewall 22 further defines an inner profile 42 of the top opening (profile internal to the sidewall) and the outer profile 44 (defined by the periphery of the sidewall).

Reservoir 20 is formed of a resilient material. The reservoir may therefore be temporarily deformed and will resume its original shape. The material of reservoir 20 is heat resistant, i.e. thermally stable, at least to temperatures commonly reached in wax warmers. In other embodiments, the reservoir and collar may be formed of a nonstick material, i.e. a material which permits easy removal of hardened wax. In an embodiment, reservoir 20 is comprised of a silicone rubber material (silicone). In an embodiment, reservoir 20 is comprised of about 100% silicone (about 100% means 100% less any residual material impurities). In another embodiment, the reservoir is comprised of about 100% high quality FDA food grade silicone material which is heat resistant to about 230° C. (about 446° F.). The silicone material may be microwave, oven, and dishwasher safe, eco-friendly, and BPA free. This silicone material may also pass European Union REACH testing (Registration, Evaluation, Authorization and Restriction of Chemicals).

FIGS. 6-9 are, respectively, perspective, top, front, and cross-sectional views of collar 30. Collar 30 has a centrally located aperture 36 surrounded by a lip 34. The collar is substantially rotationally symmetric about a longitudinal axis extending through aperture 36, and therefore views of the rear and left and right sides are substantially identical to the view of FIG. 8.

Figure 10:
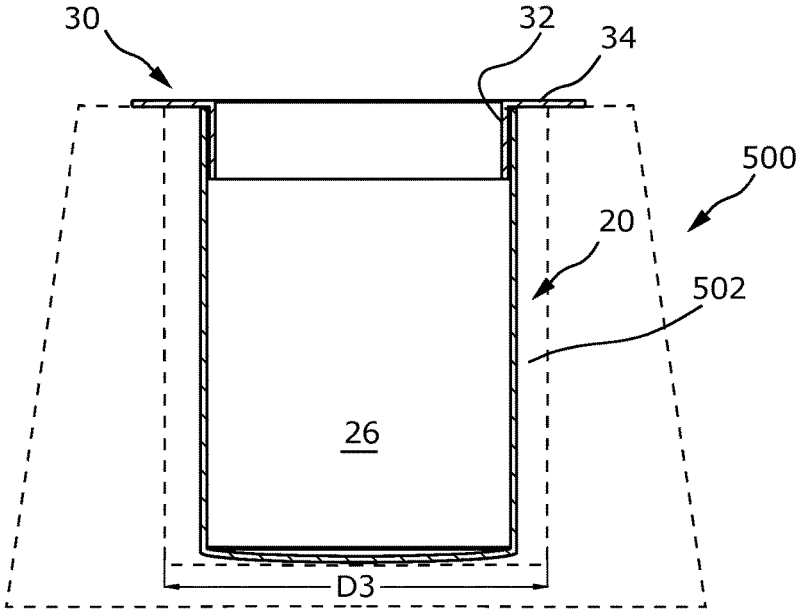
FIG. 10 is a cross-sectional view of the reservoir and collar assembled.

FIG. 10 is a cross-sectional view of reservoir 20 and collar 30 in a position of use, with a cooperating wax warmer 500 shown in broken lines. In embodiments, collar 30 may have a bottom portion 32 which is inserted into top opening 28 of reservoir 20. When collar 30 and reservoir 20 are thus assembled, lip 34 remains external to reservoir 20. Bottom portion 32 may be sized to snugly fit within the inner profile 42 of reservoir 20.

Embodiments of the collar include a lip 34 sized to completely cover heating chamber 502 of wax warmer 500 when in use. In addition to preventing wax from entering heating chamber 502, lip 34 further enables use of a smaller diameter reservoir with a larger warmer. By way of example, a reservoir having an outer diameter, D1 (see FIG. 5), of 4 inches may be used with a collar having a top lip diameter, D2 (see FIG. 9), of 5.75 inches. A reservoir having an outer diameter, D1, of 3.75 inches may be used with a collar having a top lip diameter, D2, of 5 inches. In this manner, a reservoir 20 having a smaller diameter may be used in a warmer 500 sized to accept a larger diameter container (i.e. having a heating chamber diameter, D3 (see FIG. 10), wherein D3 is significantly larger than D1).

Figure 11:
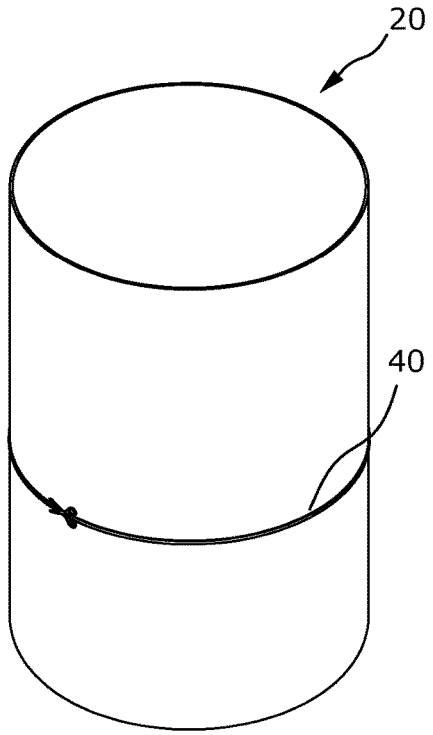
FIG. 11 is a perspective view of another embodiment of the reservoir.

The apparatus is universally sized, meaning that it is sized for use with almost any commonly used wax warmer. Reservoir 20 has a height, H (see FIG. 3), which may conveniently be reduced to accommodate a shorter wax warmer by trimming off a top section of the reservoir, such as with scissors. By way of example, the reservoir height, H, may be 2.5, 3, 3.5, 4, 5, or 5.75 inches. A reservoir having an exemplary height, H, of 5.75 inches may be trimmed to have a shorter height, for example 3 inches. In the embodiment of FIG. 11, reservoir 20 is shown marked with an indicia 40 which may guide a user in trimming the height. More than one indicia 40 may be present in other embodiments. Indicia 40 may be embossed or debossed in the exterior surface of the reservoir, or otherwise marked such as in ink.

In embodiments, collar 30 may be formed of a resilient, heat-resistant material, such as a silicone rubber material. The material of collar 30 may have properties such as those discussed above in regard to material composition of reservoir 20. Resiliency of the reservoir and collar is advantageous in that the apparatus components may be flattened for packaging, shipment, or storage, and will resume their original shape for use. By flattening reservoirs prior to shipping, the reservoirs may be packaged in a relatively small container, when compared with the rigid metal reservoirs commonly used in the art. Costs associated with shipping reservoirs may therefore be significantly reduced, resulting in both economic savings and environmental benefit.

In exemplary embodiments, reservoir 20 and collar 30 have a wall thickness, T (see FIGS. 5 & 9), of 60, 70, 80, or 90 mils.

In another embodiment, reservoir 20 and collar 30 may be unitarily formed (i.e., the reservoir and collar may be formed in a single piece).

Figure 3:
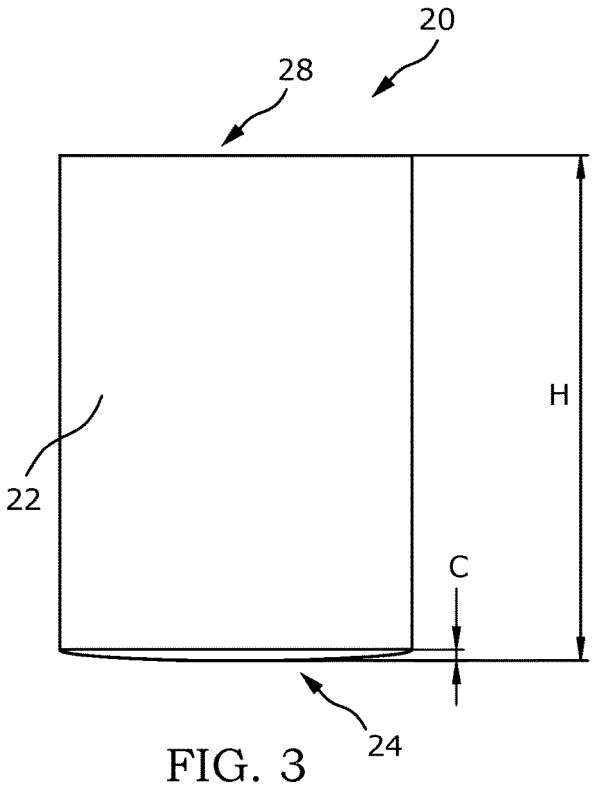
FIG. 3 is a front view of the reservoir, the rear view being identical.
Figure 2:
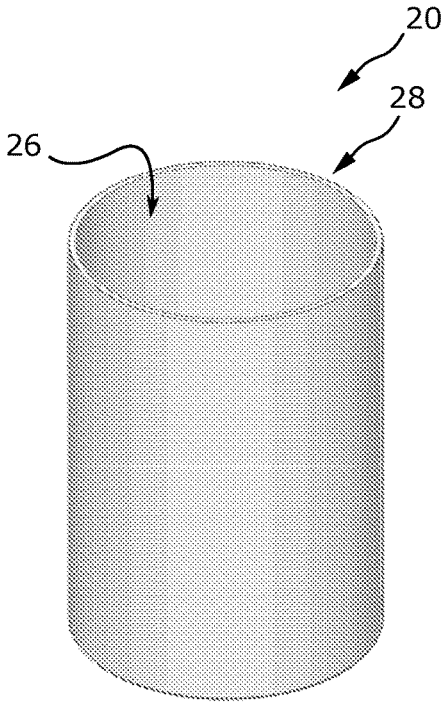
FIG. 2 is a perspective view of a reservoir of the apparatus.
Figure 5:
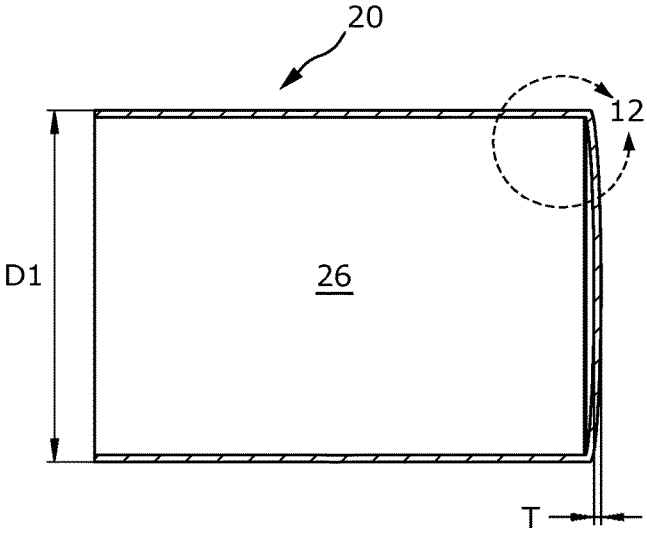
FIG. 5 is a cross-sectional view along line 5-5 of FIG. 4.
Figure 7:
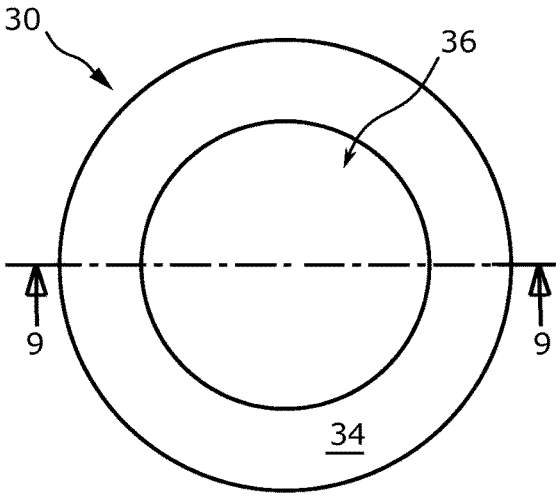
FIG. 7 is a top view of the collar.
Figure 6:
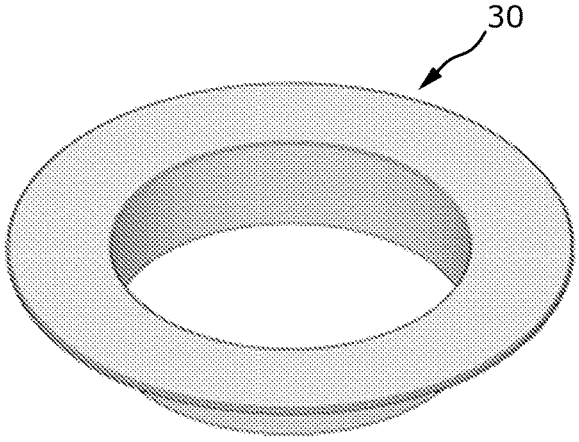
FIG. 6 is a perspective view of a collar of the apparatus.
Figure 8:
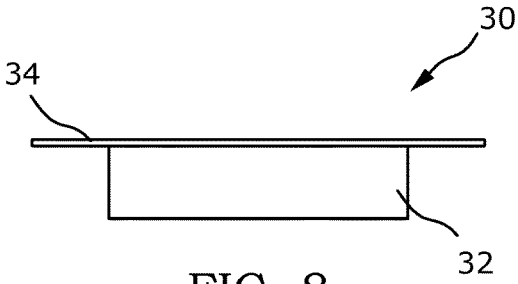
FIG. 8 is a front view of the collar.
Figure 9:
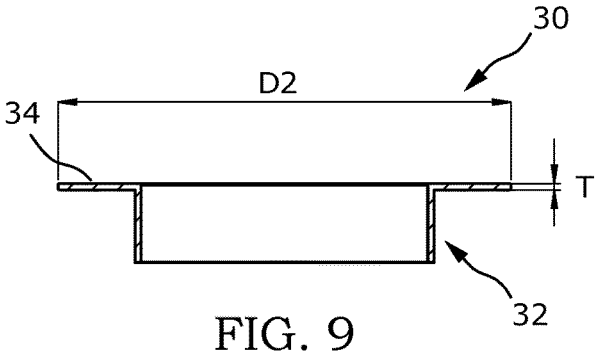
FIG. 9 is a cross-sectional view along line 9-9 of FIG. 7.

In another embodiment, best seen in FIGS. 3 & 5, bottom 24 of reservoir 20 is convex. This feature promotes complete removal of wax from the reservoir with an applicator having a round end, thereby reducing waste wax. Convex bottom 24 may, for example, have a depth, C, of 0.125, 0.187, or 0.25 inches.

Figure 12:
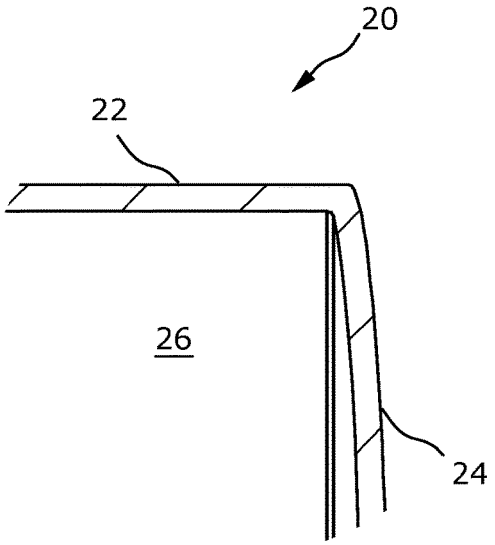
FIG. 12 is an enlarged detail view of area 12 of FIG. 5.

FIG. 12 is an enlarged detail view of area 12 of FIG. 5. In the shown embodiment, bottom 24 forms a curved abutment with sidewall 22 on the reservoir interior 26. This feature enables a rounded applicator to access the interior edge or corner of the bottom, further promoting complete removal of wax from the reservoir. In embodiments, bottom 24 may also form a curved abutment with sidewall 22 on the reservoir exterior.

Figure 13:
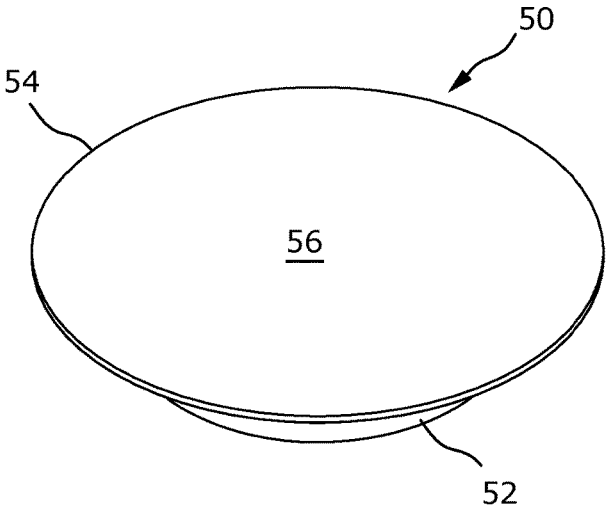
FIG. 13 is a perspective view of a lid of the apparatus.
Figure 14:
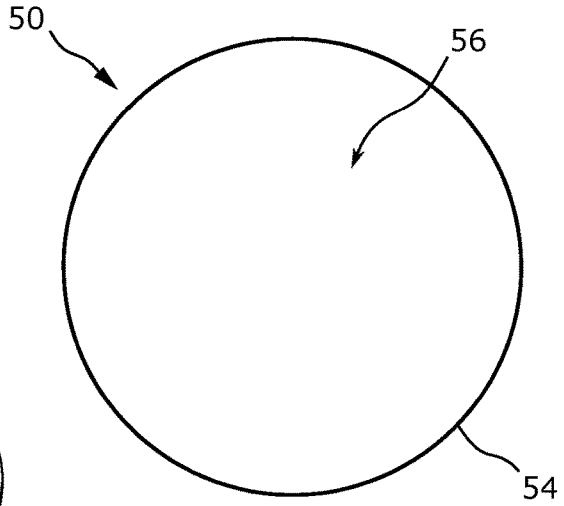
FIG. 14 is a top view of the lid.
Figure 15:
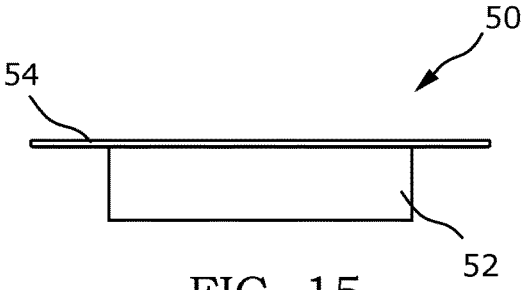
FIG. 15 is a front view of the lid.

FIGS. 13-15 are, respectively, perspective, top, and front views of lid 50, the rear, left and right side views being substantially identical to FIG. 15. Lid 50 has a closed top 56 and a bottom lid portion 52 below top 56. Bottom lid portion 52 is configured for insertion through top opening 28 of reservoir 20. In an embodiment, lid 50 may be inserted through top opening 28 to cover the reservoir when a collar and reservoir are assembled together. In this embodiment, bottom lid portion 52 may be sized to snugly fit within aperture 36 of the collar. In another embodiment, lid 50 is designed to cover reservoir 20 when a collar is not in place on the reservoir; in this case bottom lid portion 52 may be sized to snugly fit within inner profile 42 of the reservoir.

In some embodiments, lid 50 has an outer edge 54 which overhangs reservoir sidewall when installed, and is sized to cover the heating chamber of the wax warmer in a similar manner to embodiments of the lip of collar 30.

In an embodiment, reservoir 20 and collar 30 have a lime green color, such as Pantone 375C. Embodiments of lid 50 may have the same color as the reservoir and collar.

In an embodiment, a system or kit for hair removal is provided (see FIG. 1), which includes a reservoir 20 and a collar 30 in accordance with any of the embodiments described above. The resilient reservoir of the system is compressed and contained in a first package. Compression of the reservoir, for example by flattening, reduces its shipping volume. The system also includes a portion of wax 600 packaged in a second package, such as a bag 700.

In exemplary embodiments of the system, the portion of wax is a depilatory soft wax in a quantity of 10, 12, 14, or 16 ounces. The kit may include a plurality of reservoirs, a plurality of collars, a plurality of bagged portions of wax, or combinations thereof. The kit may further include one or more lids in accordance with embodiments described above. Costs associated with shipping the kit as described above are greatly reduced compared to shipping portions of soft wax contained in rigid metal reservoirs, as is current practice.

In terms of use, a method of heating depilatory wax 600 in a cooperating wax warmer 500 includes (refer to FIGS. 1-15):

(a) providing an apparatus including:

(i) a reservoir 20 shaped and dimensioned to be received by a heating chamber 502 of the wax warmer, the reservoir having a sidewall 22 and a top opening 28, the top opening having an inner profile 42 internal to and defined by the sidewall, and an outer profile 44 at the periphery of the sidewall;

(ii) a collar 30 having a lip 34 sized to extend outwardly from the outer profile of the top opening of the reservoir, and an aperture 36 surrounded by the lip and configured for alignment with the top opening, the lip sized to cover the heating chamber of the wax warmer; and, (iii) wherein the reservoir is formed of a resilient, heat resistant material;

(b) providing a portion of depilatory wax;

(c) placing the reservoir into the wax warmer;

(d) placing the portion of depilatory wax into the reservoir;

(e) arranging the collar so that the aperture is aligned with the top opening of the reservoir and the lip covers the heating chamber of the wax warmer; and, (f) warming the depilatory wax.

In embodiments, the reservoir surface is non-stick, enabling easy cleaning and reuse of the reservoir. This feature contributes to improved hygiene, waste reduction, decreased cost, and improved convenience for the user.

The method of steps (a)-(f) above, further including:

(g) after (f), permitting the portion of depilatory wax to cool until the wax is sufficiently firm to be handled;

(h) turning the reservoir inside out;

(i) peeling the portion of depilatory wax out of the reservoir; and, (j) turning the reservoir back to its original orientation.

When used with soft wax, the below method may be used to clean the reservoir for reuse. Chilling the reservoir and wax, such as in a freezer, will firm the soft wax sufficiently to permit handling in a manner similar to a room temperature hard wax. The method of steps (a)-(j) above, further including:

in (b), the portion of depilatory wax being a soft wax; and, in (g), chilling the portion of depilatory wax for a period of time sufficient to substantially firm the portion of depilatory wax.

The embodiments of the apparatus and method for heating depilatory wax described herein are exemplary and numerous modifications, combinations, variations, and rearrangements can be readily envisioned to achieve an equivalent result, all of which are intended to be embraced within the scope of the appended claims. Further, nothing in the above-provided discussions of the apparatus and method should be construed as limiting the invention to a particular embodiment or combination of embodiments. The scope of the invention is defined by the appended claims.

We claim:

1. A method of heating depilatory wax in a cooperating wax warmer, the method comprising:

(a) providing an apparatus including:

(i) a reservoir shaped and dimensioned to be received by a heating chamber of the wax warmer, the reservoir having a sidewall and a top opening, the top opening having an inner profile internal to and defined by the sidewall, and an outer profile at the periphery of the sidewall;

(ii) a collar having a lip sized to extend outwardly from the outer profile of the top opening of the reservoir, and an aperture surrounded by the lip and configured for alignment with the top opening, the lip sized to cover the heating chamber of the wax warmer; and, (iii) wherein the reservoir is formed of a resilient, heat resistant material;

(b) providing a portion of depilatory wax;

(c) placing the reservoir into the wax warmer;

(d) placing the portion of depilatory wax into the reservoir;

(e) arranging the collar so that the aperture is aligned with the top opening of the reservoir and the lip covers the heating chamber of the wax warmer;

(f) warming the portion of depilatory wax;

(g) after (f), permitting the portion of depilatory wax to cool;

(h) turning the reservoir inside out;

(i) peeling the portion of depilatory wax out of the reservoir; and, (j) turning the reservoir back to its original orientation.

2. The method according to claim 1, further including:

in (b), the portion of depilatory wax being a soft wax; and, in (g), chilling the portion of depilatory wax for a period of time sufficient to substantially firm the portion of depilatory wax.

* * * * *